US008734543B2

(12) United States Patent
Baustian

(10) Patent No.: US 8,734,543 B2
(45) Date of Patent: May 27, 2014

(54) OXYGENATED GASOLINE COMPOSITION HAVING GOOD DRIVEABILITY PERFORMANCE

(75) Inventor: James Baustian, Warrenville, IL (US)

(73) Assignees: Butamax Advanced Biofuels LLC DE (US); BP Corporation North America Inc

( * ) Notice: Subject to any disclaimer, the term of this patent is extended or adjusted under 35 U.S.C. 154(b) by 613 days.

(21) Appl. No.: 12/431,217

(22) Filed: Apr. 28, 2009

(65) Prior Publication Data

US 2009/0277079 A1 Nov. 12, 2009

Related U.S. Application Data

(60) Provisional application No. 61/051,536, filed on May 8, 2008.

(51) Int. Cl.
*C10L 1/18* (2006.01)
*C10L 1/182* (2006.01)

(52) U.S. Cl.
USPC ..... 44/451; 44/452; 123/1 A

(58) Field of Classification Search
USPC ..... 44/451, 452, 453, 454, 455; 123/1 A
See application file for complete search history.

(56) References Cited

U.S. PATENT DOCUMENTS

| | | | | |
|---|---|---|---|---|
| 1,907,309 | A * | 5/1933 | Van Schaack, Jr. | 44/451 |
| 5,755,833 | A | 5/1998 | Ishida et al. | |
| 5,782,937 | A | 7/1998 | Colucci et al. | |
| 6,083,288 | A | 7/2000 | Wolf | |
| 2004/0107634 | A1 * | 6/2004 | Binions | 44/359 |
| 2004/0123516 | A1 * | 7/2004 | Hull et al. | 44/349 |
| 2004/0123518 | A1 * | 7/2004 | Eastman et al. | 44/446 |
| 2008/0086933 | A1 * | 4/2008 | Cunningham et al. | 44/451 |

FOREIGN PATENT DOCUMENTS

| | | |
|---|---|---|
| AU | 7093881 | 11/1981 |
| WO | 2004055134 | 7/2004 |
| WO | 2006081089 | 8/2006 |

OTHER PUBLICATIONS

"Ashless Antiknock Compounds for Automotive Gasolines" by Karpov, Kokhanov, Tsarev and Kapustin, Chemistry and Technology of Fuels and Oils, vol. 42, No. 6, 2006.*

International Search Report and Written Opinion in corresponding PCT/US2009/042550 Sep. 15, 2009.

Karpov et al., Chemistry and Technology of Fuels and Oils, vol. 42, No. 6, pp. 404-411 (2006).

International Preliminary Report on Patentability mailed Nov. 18, 2010 in corresponding PCT/US2009/042550.

* cited by examiner

*Primary Examiner* — Pamela H Weiss

(57) ABSTRACT

A method for producing a gasoline blend having a high concentration of a butanol isomer and having good cold start and warm-up driveability performance.

8 Claims, 2 Drawing Sheets

OXYGENATED GASOLINE COMPOSITION HAVING GOOD DRIVEABILITY PERFORMANCE

Figure 1:
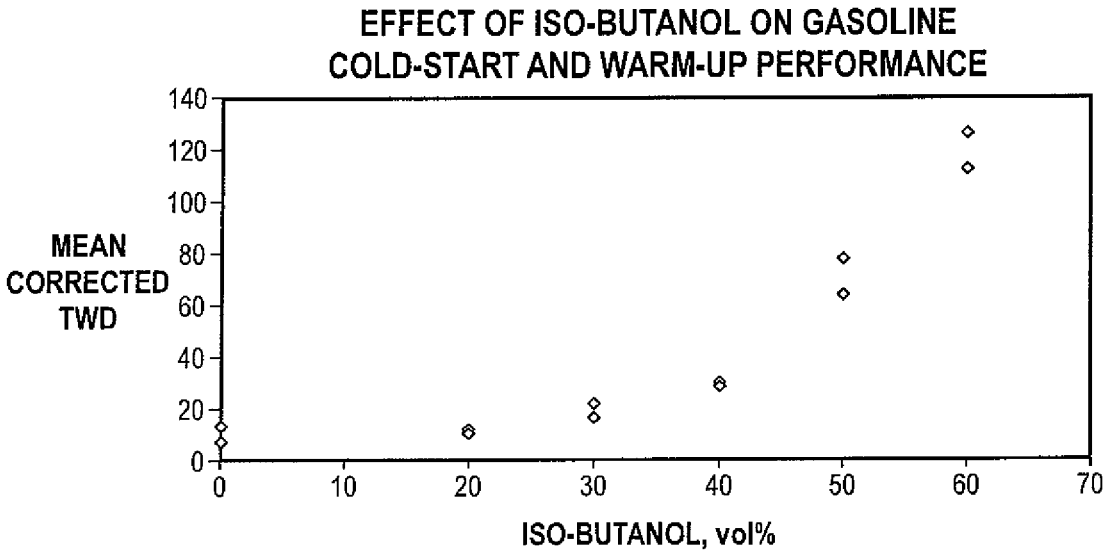

This application claims benefit of provisional application Ser. No. 61/051,536 filed May 8, 2008, which is incorporated herein by reference in its entirety.

BACKGROUND OF THE INVENTION

This invention relates to fuels, more particularly to oxygenated gasolines including gasolines containing a high concentration of a butanol. This invention provides an oxygenated gasoline having good driveability performance.

Gasolines are fuels which are suitable for use in a spark-ignition engine and which generally contain as a primary component a mixture of numerous hydrocarbons having different boiling points and typically boiling at a temperature in the range of from about 79° F. to about 437° F. under atmospheric pressure. This range is approximate and can vary depending upon the actual mixture of hydrocarbon molecules present, the additives or other compounds present (if any), and the environmental conditions. Typically, the hydrocarbon component of gasolines contain $C_4$ to $C_{10}$ hydrocarbons.

Gasolines are typically required to meet certain physical and performance standards. Some characteristics may be implemented for proper operation of engines or other fuel combustion apparatuses. However, many physical and performance characteristics are set by national or regional regulations for other reasons such as environmental management. Examples of physical characteristics include Reid Vapor Pressure, sulfur content, oxygen content, aromatic hydrocarbon content, benzene content, olefin content, temperature at which 90 percent of the fuel is distilled (T90), temperature at which 50 percent of the fuel is distilled (T50) and others. Performance characteristics can include octane rating, combustion properties, and emission components.

For example, standards for gasolines for sale within much of the United States are generally set forth in ASTM Standard Specification Number D 4814-07a ("ASTM D4814") which is incorporated by reference herein. Additional federal and state regulations supplement this standard. The specifications for gasolines set forth in ASTM D4814 vary based on a number of parameters affecting volatility and combustion such as weather, season, geographic location and altitude. For this reason, gasolines produced in accordance with ASTM D4814 are broken into volatility categories AA, A, B, C, D and E, and vapor lock protection categories 1, 2, 3, 4, 5, and 6, each category having a set of specifications describing gasolines meeting the requirements of the respective classes. This specifications also sets forth test methods for determining the parameters in the specification.

For example, a Class AA-2 gasoline blended for use during the summer driving season in relatively warm climates must have a maximum vapor pressure of 7.8 psi, a maximum temperature for distillation of 10 percent of the volume of its components (the "T10") of 158° F., a temperature range for distillation of 50 percent of the volume of its components (the "T50") of between 170° F. and 240° F., a maximum temperature for distillation of 90 percent of the volume of its components (the "T90") of 374° F., a distillation end point of 437° F., a distillation residue maximum of 2 volume percent, and a "Driveability Index" or "DI" maximum temperature of 1250° F. In particular, when a gasoline blend contains ethanol, ASTM D4814 uses a linear combination of D86 distillation temperatures and ethanol concentration to calculate the Driveability Index (DI), as follows:

$$DI=1.5(T10)+3(T50)+T90+2.4(\text{ethanol vol. }\%) \qquad \text{Equation (A)}$$

However, control experiments have indicated that cold start and warm-up driveability performances can be problematic for gasoline blends that contain a high concentration of a butanol. It has also been found that existing methods for predicting cold start and warm-up driveability performance from fuel volatility parameters, such as the aforesaid Driveability Index (DI) are ineffective for high-butanol blends.

SUMMARY OF THE INVENTION

The present invention is a method for producing a gasoline blend having a high concentration of a butanol that has good cold start and warm-up driveability performance, comprising: a) forming a blend of a high concentration of at least one butanol isomer and at least one gasoline blending stock; and b) maintaining at least 35 volume percent the volume fraction of the resulting gasoline blend that evaporates at temperatures up to about 200° F. The blend that is formed by the method of this invention contains preferably at least about 20 volume percent, more preferably at least about 30 volume percent, and most preferably at least about 40 volume percent of the at least one butanol isomer. Preferably the at least one butanol isomer in the gasoline blend formed by the method of this invention comprises isobutanol. The present invention is also the resulting gasoline blend that is formed by the method of this invention.

DESCRIPTION OF THE PREFERRED EMBODIMENTS

Gasolines are well known in the art and generally contain as a primary component a mixture of hydrocarbons having different boiling points and typically boiling at a temperature in the range of from about 79° F. to about 437° F. under atmospheric pressure. This range is approximate and can vary depending upon the actual mixture of hydrocarbon molecules present, the additives or other compounds present (if any), and the environmental conditions. Oxygenated gasolines are a blend of a gasoline blend stock and one or more oxygenates.

Gasoline blend stocks can be produced from a single component, such as the product from a refinery alkylation unit or other refinery streams. However, gasoline blend stocks are more commonly blended using more than one component. Gasoline blend stocks are blended to meet desired physical and performance characteristics and to meet regulatory requirements and may involve a few components, for example three or four, or may involve many components, for example, twelve or more.

Gasolines and gasoline blend stocks optionally may include other chemicals or additives. For example, additives or other chemicals can be added to adjust properties of a gasoline to meet regulatory requirements, add or enhance desirable properties, reduce undesirable detrimental effects, adjust performance characteristics, or otherwise modify the characteristics of the gasoline. Examples of such chemicals or additives include detergents, antioxidants, stability enhancers, demulsifiers, corrosion inhibitors, metal deactivators, and others. More than one additive or chemical can be used.

Useful additives and chemicals are described in Colucci et al., U.S. Pat. No. 5,782,937, which is incorporated by reference herein. Such additives and chemicals are also described in Wolf, U.S. Pat. No. 6,083,228, and Ishida et al., U.S. Pat. No. 5,755,833, both of which are incorporated by reference herein. Gasolines and gasoline blend stocks may also contain solvents or carrier solutions which are often used to deliver additives into a fuel. Examples of such solvents or carrier solutions include, but are not limited to, mineral oil, alcohols, carboxylic acids, synthetic oils, and numerous other which are known in the art.

Gasoline blend stocks suitable for use in the method of this invention are typically blend stocks useable for making gasolines for consumption in spark ignition engines or in other engines which combust gasoline. Suitable gasoline blend stocks include blend stocks for gasolines meeting ASTM D4814 and blend stocks for reformulated gasoline. Suitable gasoline blend stocks also include blend stocks having low sulfur content which may be desired to meet regional requirements, for example having less than about 150, preferably less than about 100, and more preferably less than about 80 parts per million parts by volume of sulfur. Such suitable gasoline blend stocks also include blend stocks having low aromatics content which may be desirable to meet regulatory requirements, for example having less than about 8000 and preferably less than about 7000 parts per million parts by volume of benzene, or for example, having less than about 35 and preferably less than about 25 volume percent of total of all aromatic species present.

An oxygenate such as ethanol can also be blended with the gasoline blending stock. In that case, the resulting gasoline blend includes a blend of one or more gasoline blending stocks and one or more suitable oxygenates. In another embodiment, one or more butanol isomers can be blended with one or more gasoline blending stocks and, optionally, with one or more suitable oxygenates such as ethanol. In such embodiment, one or more gasoline blend stocks, one or more butanol isomers and optionally one or more suitable oxygenates can be blended in any order. For example, a butanol can be added to a mixture, including a gasoline blend stock and suitable oxygenates. As another example, one or more suitable oxygenates and a butanol can be added in several different locations or in multiple stages. For further examples, a butanol, more preferably isobutanol, can be added with the suitable oxygenates, added before the suitable oxygenates or blended with the suitable oxygenates before being added to a gasoline blend stock. In a preferred embodiment, a butanol, more preferably isobutanol, is added to oxygenated gasoline. In another preferred embodiment, one or more suitable oxygenates and a butanol can be blended into a gasoline blend stock contemporaneously.

In any such embodiment the one or more butanol and optionally one or more suitable oxygenates can be added at any point within the distribution chain. For example, a gasoline blend stock can be transported to a terminal and then a butanol and optionally one or more suitable oxygenates can be blended with the gasoline blend stock, individually or in combination, at the terminal. As a further example, the one or more gasoline blending stocks, one or more butanol isomers and optionally one or more suitable oxygenates can be combined at a refinery. Other components or additives can also be added at any point in the distribution chain. Furthermore, the method of the present invention can be practiced at a refinery, terminal, retail site, or any other suitable point in the distribution chain.

Since butanol isomers boil near the midpoint of the gasoline boiling range, if relatively low concentration of a butanol isomer is blended with a gasoline blending stock, the evaporation characteristics of the resulting gasoline blend would not be significantly altered. As a result, the cold start and warm-up performance of such gasoline blends containing relatively low concentrations of a butanol isomer is essentially the same as the corresponding gasoline blend that contains no butanol. However, when a relatively higher concentration of a butanol isomer is blended with a gasoline blending stock, the resulting gasoline blend contains a large fraction having a single, relatively high boiling point, and the presence of this large mid-boiling fraction adversely affects the overall evaporation characteristics of the resulting gasoline blend, especially its front-end volatility. Such a change in volatility can prevent the gasoline blend from readily forming flammable air/fuel mixtures in engine intake systems at ambient temperature, and thus cause poor cold start and warm-up driveability performance.

Such poor performance is illustrated in FIG. 1, which includes the results from a six-car test of driveability performance for gasoline blends containing varying concentrations of isobutanol. Driveability faults include problems such as long crank times, stalls and surging. In FIG. 1 driveability faults expressed as mean total-weighted demerits (TWD) and corrected for temperature and vehicle effects are plotted versus the concentrations of isobutanol in the gasoline blends tested. The results in FIG. 1 illustrate that the driveability faults for gasoline blends that contain low concentrations of isobutanol are similar to those for gasoline blends that contain no isobutanol. However, the driveability faults increase dramatically for gasoline blends that contain relatively larger concentrations of isobutanol.

Driveability problems in a gasoline blend are typically remedied by rebalancing the volatility of the blend using the linear combination of distillation temperatures and ethanol concentration in the Driveability Index Equation (A) above which describes the overall volatility of the gasoline blend. Research by the Coordinating Research Council and others has shown that the Driveability Index successfully relates the fuel volatility parameters to vehicle driveability. Since driveability faults increase predictably with increasing Driveability Index, specifications of maximum Driveability Indices are adequate to ensure good driveability in customary gasoline blends.

Figure 2:
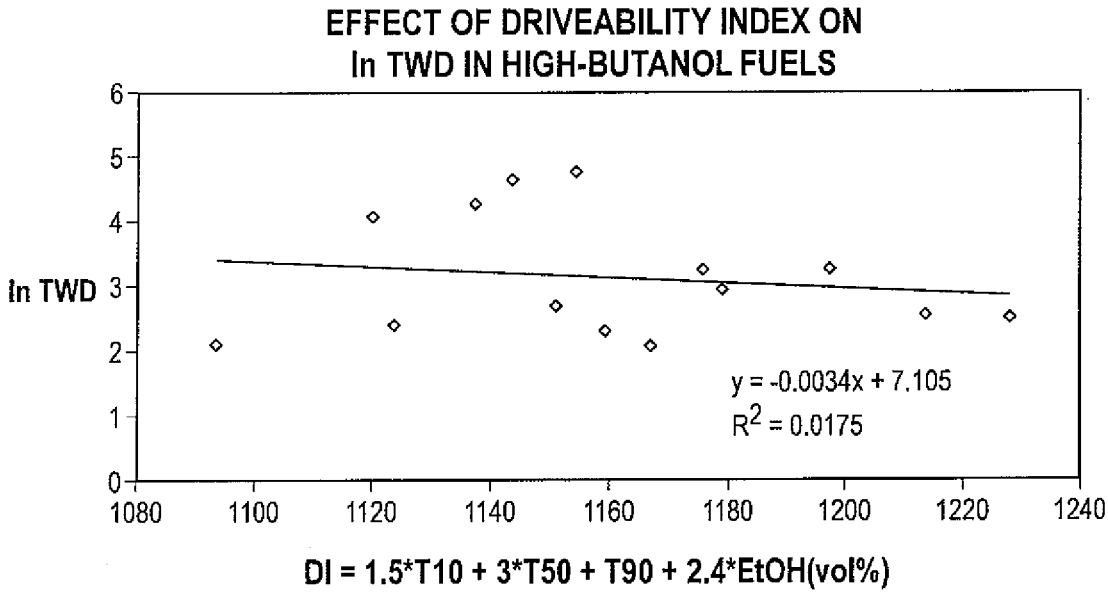

However, as illustrated in FIG. 2 and by the very low value of $R^2$, the Driveability Index does not describe the relationship between driveability and volatility in high-butanol gasoline blends. In FIG. 2, the logarithms of the same total weighted demerits (TWD) data from the same six-car trial described above are plotted versus the Driveability Indices for the same isobutanol-gasoline blends with respect to FIG. 1. The results in FIG. 2 demonstrate that the Driveability Index does not describe the relationship between volatility and driveability for these high concentration isobutanol fuels and hence is not useful as a means for predicting or controlling driveability performance in such gasoline blends.

Figure 3:
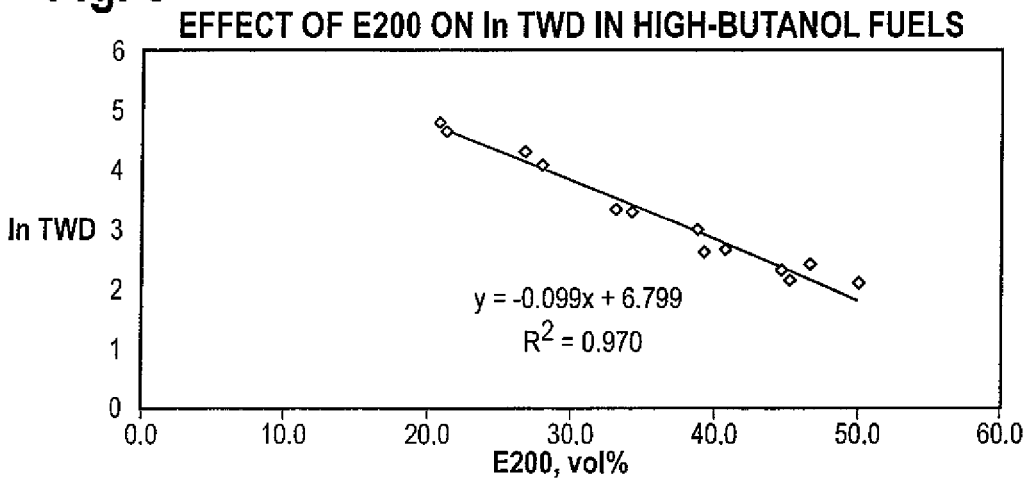

By contrast, FIG. 3 presents a plot of the same logarithms of the total-weighted demerits (TWD) versus the volume fraction that evaporates at temperatures up to about 200° F., symbolized as E200, of the same isobutanol-gasoline blends employed for the plot in FIG. 2. The plot in FIG. 3 and the very low value of $R^2$ demonstrate a very accurate determination of the relationship between volatility and driveability performance for gasoline blends containing high concentrations of butanols.

Figure 4:
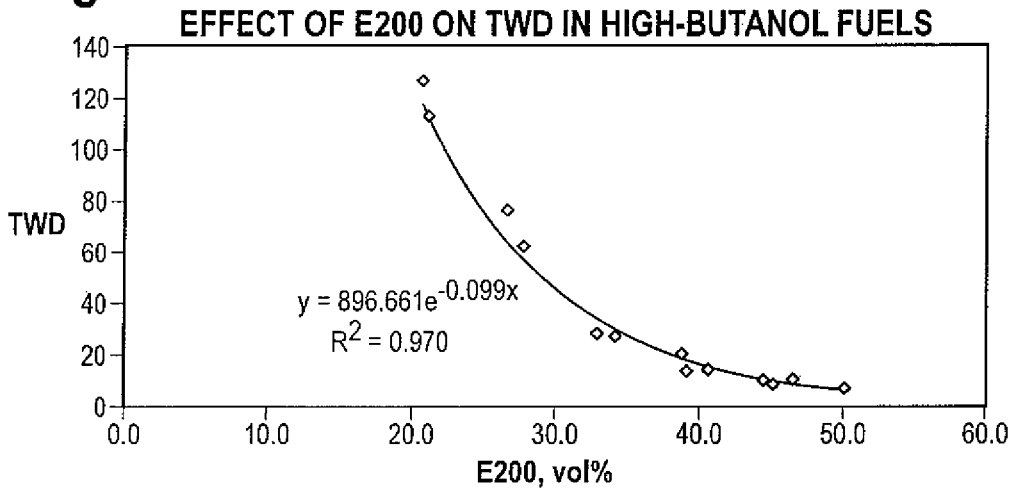

FIG. 4 contains a plot of the total-weighted demerits (TWD) per se, not their logarithms, versus the volume fraction of the same isobutanol-gasoline blends employed for FIGS. 2 and 3. FIG. 4 and the very low value of $R^2$ demonstrate that when E200 of a gasoline blend that contains high concentrations of a butanol is at least 35 percent, preferably at least 40 percent, and more preferably at least 45 percent, driveability demerits, represented by TWD, are maintained at a low level that is essentially equivalent to that of gasoline blends with no butanol component.

The data that were employed for the plots in FIGS. 1-4 were obtained using two base fuels: one with summer (about Class B) volatility and the other with winter (Class D) volatility. Test blends included isobutanol concentrations of 0, 5, 11, 15, 20, 30, 40, 50, and 60 volume percent. Volatility parameters including Reid vapor pressure, D86 distillation, and T (V/L=20) were measured in the laboratory. The gasoline blends were tested for driveability performance in a fleet of six late model low-emission cars according to industry standard CRC E28-94 procedures in a dynamometer test cell. Ambient temperatures for the driveability tests ranged from 20 to 70° F. Two additional reference gasoline blends containing no isobutanol were also tested: one blend matched ASTM DI specifications for Class B (summer) fuels, and the other represented typical ASTM Class D (winter) properties. A total of 192 driveability tests were conducted.

Figure 5:
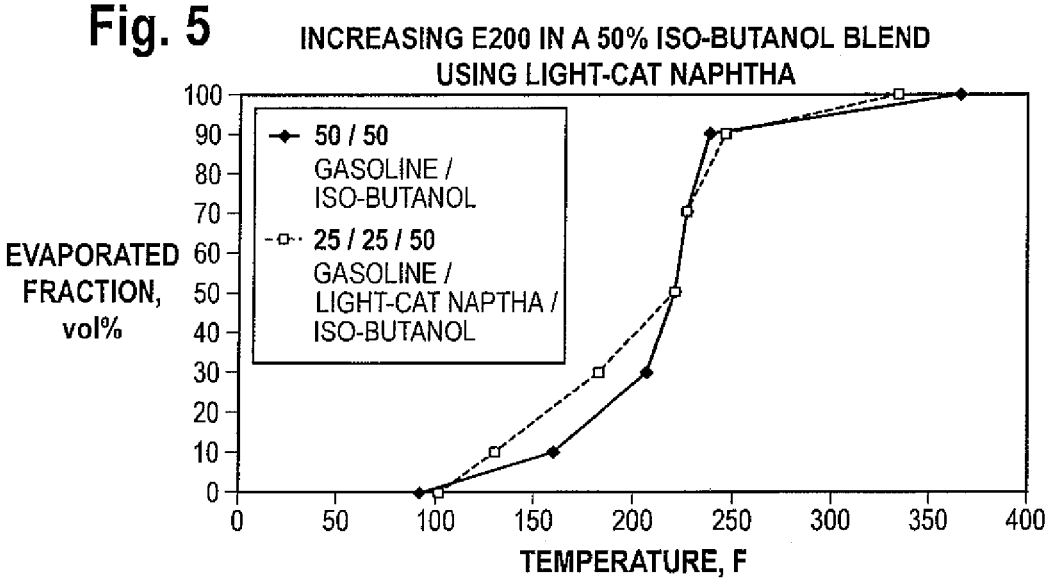

FIG. 5 demonstrates the use of the method of this invention to improve the poor driveability performance of a gasoline blend that contains a high concentration of a butanol. In FIG. 5, the evaporated fraction in volume percent of a gasoline blend containing 50 volume percent of isobutanol is plotted versus the temperature at which the gasoline blend is heated. When half of the original gasoline blending stock is replaced with a light-cat naphtha such that the resulting modified gasoline blend contains 25 volume percent of the original gasoline blending stock employed, 25 volume percent of the light-cat naphtha and 50 volume percent of isobutanol, the plot of its evaporated fraction in volume percent versus the temperature at which the modified gasoline blend is heated, the evaporated fraction at 200° F., which is its E200 value, increases from about 28 volume percent for the original gasoline blend to about 39 volume percent for the modified gasoline blend. The driveability performance of the resulting modified gasoline blend is significantly improved and is essentially equivalent to that of the gasoline without a butanol component. Thus, the present invention is a method for producing a gasoline blend having good cold start and warm-up driveability performance that comprises a) blending a high concentration, preferably at least 20, more preferably at least 30, and most preferably at least 40 volume percent, of at least one butanol isomer, which preferably comprises isobutanol, into gasoline; and b) maintaining the volume fraction of the resulting blend that evaporates at temperatures up to about 200° F. at least 35, preferably at least 40, more preferably at least 45, and most preferably at least 50 volume percent. The present invention is also the resulting gasoline blend.

It will be appreciated by those skilled in the art that, while the present invention has been described herein by reference to specific means, materials and examples, the scope of the present invention is not limited thereby, and extends to all other means and materials suitable for practice of the present invention.

That which is claimed is:

1. A method for producing a gasoline blend having good cold start and warm-up driveability performance comprising blending at least one butanol isomer, one or more hydrocarbon blend stocks, and optionally one or more additives, to form a gasoline blend;

determining the volatility of a volume fraction of the gasoline blend at temperatures up to about 200° F. (E200) by a distillation test; and adjusting the volume percent of the at least one butanol isomer, the concentrations of the one or more hydrocarbon blend stocks, or a combination thereof to provide a gasoline blend having an E200 of at least 35 volume percent.

2. The method of claim 1, wherein the concentration of the at least one butanol isomer is at least 40 volume percent of the of the gasoline blend.

3. The method of claim 1, wherein the at least one butanol isomer comprises isobutanol.

4. The method of claim 1, wherein the volume fraction of the gasoline blend that evaporates at temperatures up to about 200° F. (E200) is at least 40 volume percent of the gasoline blend.

5. The method of claim 1, wherein the volume fraction of the gasoline blend that evaporates at temperatures up to about 200° F. (E200) is at least 45 volume percent of the gasoline blend.

6. The method of claim 1, wherein the volume fraction of the gasoline blend that evaporates at temperatures up to about 200° F. (E200) is at least 50 volume percent of the gasoline blend.

7. The method of claim 1, wherein the concentration of the at least one butanol isomer is at least 30 volume percent of the of the gasoline blend.

8. The method of claim 1, wherein the one or more additives is selected from detergents, antioxidants, stability enhancers, demulsifiers, corrosion inhibitors, and metal deactivators.

* * * * *